US009603211B2

(12) United States Patent
Yu et al.

(10) Patent No.: US 9,603,211 B2
(45) Date of Patent: Mar. 21, 2017

(54) LED DRIVER

(71) Applicant: Silergy Semiconductor Technology (Hangzhou) LTD, Hangzhou, ZheJiang Province (CN)

(72) Inventors: Feng Yu, Hangzhou (CN); Chen Zhao, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 15/148,287

(22) Filed: May 6, 2016

(65) Prior Publication Data

US 2016/0255691 A1 Sep. 1, 2016

Related U.S. Application Data

(63) Continuation-in-part of application No. 14/496,294, filed on Sep. 25, 2014, now Pat. No. 9,420,652.

(30) Foreign Application Priority Data

Sep. 29, 2013 (CN) ..... 2013 1 0460841

(51) Int. Cl.
*H05B 37/00* (2006.01)
*H05B 33/08* (2006.01)

(52) U.S. Cl.
CPC ..... *H05B 33/0827* (2013.01); *H05B 33/0809* (2013.01); *H05B 33/0824* (2013.01); *H05B 33/0845* (2013.01)

(58) Field of Classification Search
CPC ..... H05B 33/0803; H05B 33/0827; H05B 33/0821; H05B 41/34; H05B 33/0809; F21Y 2101/02
USPC ..... 315/200 R, 201, 209 R, 210, 185 R
See application file for complete search history.

(56) References Cited

U.S. PATENT DOCUMENTS

| | | | | |
|---|---|---|---|---|
| 8,492,988 | B2 | 7/2013 | Nuhfer et al. | |
| 2011/0273102 | A1 | 11/2011 | Van de Ven et al. | |
| 2012/0133284 | A1 | 5/2012 | Ge et al. | |
| 2012/0181940 | A1* | 7/2012 | Snelten | H05B 33/0815 315/186 |
| 2012/0235579 | A1 | 9/2012 | Chemel et al. | |
| 2012/0268013 | A1 | 10/2012 | Riesebosch | |

(Continued)

FOREIGN PATENT DOCUMENTS

| | | | |
|---|---|---|---|
| CN | 101137261 | B | 3/2011 |
| CN | 102158082 | A | 8/2011 |

(Continued)

*Primary Examiner* — Minh D A
(74) *Attorney, Agent, or Firm* — Michael C. Stephens, Jr.

(57) ABSTRACT

An LED driver can include: a rectifier circuit receiving an AC voltage, and providing a DC output voltage; an LED array having N LED units having at least one LED coupled between first and second output terminals of the DC output voltage; (N−1) groups of switches, each having two switches coupled in series between the first and second output terminals, where a common node of the two switches is coupled to a common node between two adjacent LED units, where the operation of the two switches of each group is complementary such that when the switch is on, the LED unit coupled in parallel with the switch is out of operation; and an LED configuration control circuit that controls the on/off states of switches to control operation of the LED units.

14 Claims, 8 Drawing Sheets

(56) References Cited

U.S. PATENT DOCUMENTS

| | | | | |
|---|---|---|---|---|
| 2013/0002155 | A1* | 1/2013 | Hu | H05B 33/0809 315/186 |
| 2013/0241423 | A1 | 9/2013 | Chu | |

FOREIGN PATENT DOCUMENTS

| | | | |
|---|---|---|---|
| CN | 102437744 | A | 5/2012 |
| CN | 102498449 | A | 6/2012 |
| CN | 102870501 | A | 1/2013 |
| CN | 103281823 | A | 9/2013 |

* cited by examiner

LED DRIVER

RELATED APPLICATIONS

This application is a continuation-in-part of U.S. patent application Ser. No. 14/496,294, filed on Sep. 25, 2014, and which is hereby incorporated by reference as if it is set forth in full in this specification, and which also claims the benefit of Chinese Patent Application No. 201310460841.6, filed on Sep. 29, 2013, which is incorporated herein by reference in its entirety.

FIELD OF THE INVENTION

The present invention generally relates to a driving circuit, and more specifically to a light-emitting diode (LED) driver.

BACKGROUND

The power factor (PF) of an AC-DC LED driver should be limited within a certain range, in order to meet harmonic standards. Typical AC-DC LED drivers may be of a single-stage type or of a two-stage type. The single-stage type of AC-DC LED driver may have a large PF value by providing suitable parameters. However, control variables are selected in a limited scope, and may not be suitable for optimizing efficiency of the LED driver. An electrolytic capacitor should be included, which may however reduce the lifetime of the LED driver, and can cause flicker that may be observable by human eyes.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

The two-stage type of AC-DC light-emitting driver (LED) driver may be controlled with control variables in a full range, may have a high PF value, and can be suitable for optimizing the efficiency of the LED driver, without flicker that is observable by human eyes. The LED driver may have an input for receiving a pulsed power supply, an output for providing a flat power supply, and a storage capacitor at an intermediate bus for balancing the power supplies. If the storage capacitor is an electrolytic capacitor, it may adversely influence the lifetime of the LED driver. If the storage capacitor is a ceramic capacitor or a thin-film capacitor, its operation voltage range may limit an intermediate bus voltage, or its footprint may be too large for providing a large voltage range. The capacitor can also increase the cost of the LED driver if it has a relatively large footprint.

Figure 1:
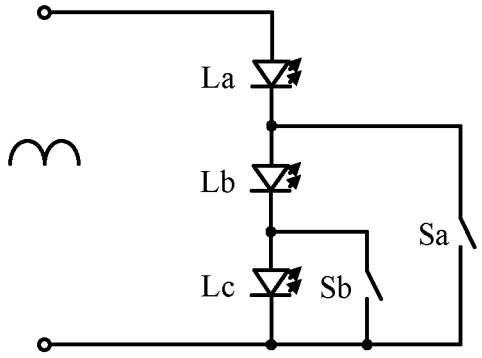
FIG. 1 is a schematic block diagram of an example LED string.

Referring now to FIG. 1, shown is a schematic block diagram of an example LED string. In this example AC-DC LED driver that uses multiple bus voltages, no electrolytic capacitor may be needed for power balancing/control, and thus the lifetime of the LED driver can be increased without potential flicker problems. Such a control scheme may have a beneficial effect of avoiding flicker, but may have an adverse effect of non-uniform utilization of LEDs. For example, LED La can maintain an on state when switch Sa is closed, LEDs La and Lb can maintain an on state when switch Sb is closed, and LEDs La, Lb, and Lc can maintain an on state when switches Sa and Sb are both opened. LED La may have a utilization that is higher than that of LEDs Lb and Lc, which can adversely influence the system lifetime. Thus, the utilization of LEDs can be low or non-uniform such an LED configuration scheme, which can result in a reduced system lifetime.

In one embodiment, an LED driver can include: (i) a rectifier circuit having an input for receiving an AC voltage, and an output for providing a DC output voltage by rectifying the AC voltage; (ii) an LED array having N LED units having at least one LED coupled between a first output terminal and a second output terminal of the DC output voltage; (iii) (N−1) groups of switches, each group of switches having two switches coupled in series between the first and second output terminals of the DC output voltage, where a common node of the two switches of each group is coupled to a common node between two adjacent LED units, and where the operation of the two switches of each group is complementary such that when the switch is on, the LED unit coupled in parallel with the switch is out of operation; and (iv) an LED configuration control circuit configured to control the on and off states of switches to correspondingly control operation of the LED units in accordance with a value of the DC output voltage and a current requirement for a current flowing through the LED units.

Figure 2A:
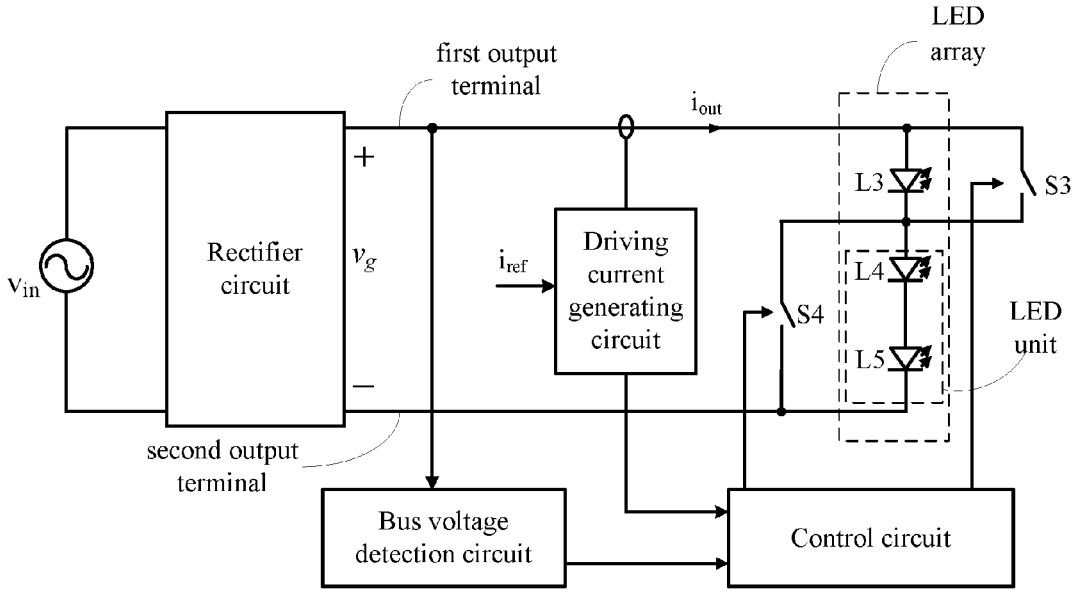
FIG. 2A is a schematic block diagram of a first example LED driver, in accordance with embodiments of the present invention.

Referring now to FIG. 2A, shown is a schematic block diagram of a first example LED driver, in accordance with embodiments of the present invention. In this particular example, an LED driver can include a rectifier circuit, a driving current generating circuit, a bus voltage detection circuit, an LED configuration control circuit, and an LED array that includes a plurality of LED units. For example, the rectifier circuit may have an input for receiving an AC voltage, and an output for providing a DC output voltage that is obtained by rectifying an AC voltage. The LED array can include two LED units including at least one LED(s) coupled between a first output terminal and a second output terminal of the DC output voltage.

One group of switches can include two switches, where the two switches are coupled in series between the first output terminal and the second output terminal of the DC output voltage. Also, a common node of the two switches of each of the groups can connect to a common node between two adjacent LED units. Further, an LED configuration control circuit can control the on and off states of the two switches, in order to correspondingly control the operation of the LED units in accordance with the value of the DC output voltage, as well as a current requirement for a current flowing through the LED units. The operation of the two switches of each of the group of switches may be complementary such that when the switch is on, the LED unit coupled in parallel with the switch is out of operation.

In this particular example, the LED driver can also include a bus voltage detection circuit that detects the DC output voltage. The LED driver can also include a driving current generating circuit that controls the current flowing through the LED units in accordance with current requirements that can be indicated as a current reference $i_{ref}$. The control circuit can be coupled to the bus voltage detection circuit and the driving current generating circuit, in order to generate corresponding control signals for controlling operation of the two switches S3 and S4.

When the DC output voltage is increasing, or in an increasing state, the number of the LED units in operation can increase through the control of the switches. For example, at the beginning of the first quarter of a period of AC voltage $V_{in}$, the value of the DC output voltage may be smaller than a first level. Therefore, switch S4 can be turned on and switch S3 may be off, and the current may only flow through the LED unit that includes LED L3. When the value of the DC output voltage increases to a second level, switch S3 can be turned on and switch S4 may be off, and the current may only flow through the LED unit that includes LEDs L4 and L5. When the value of the DC output voltage increases to a third level, both of switches S3 and S4 may be turned off, and the current may only flow through the two LED units that includes LEDs L3, L4, and L5.

When the DC output voltage is decreasing, or in a decreasing state, the number of the LED units in operation may decrease through the control of the switches. For example, at the beginning of the second quarter of a period of the AC voltage $V_{in}$, the value of the DC output voltage may be higher than a third level. Therefore, both of switches S3 and S4 can be turned off, and the current may only flow through the two LED units that includes LEDs L3, L4, and L5. When the value of the DC output voltage decreases to a second level, switch S3 may be turned on and switch S4 may be off, and the current may only flow through the LED unit that includes LEDs L4 and L5. When the value of the DC output voltage decreases to a first level, switch S4 may be turned on and switch S3 may be off, and the current may only flow through the LED unit that includes LED L3.

In this way, in accordance with the value of the DC output voltage, current can flow through corresponding LED units. Therefore, the LED units can be alternated in operation in order to improve the utilization of all LEDs, and to increase the lifetime of the LEDs. Furthermore, the current flowing through the LEDs can be controlled by the driving current generating circuit. When switches S3 and S4 are turned on, switches S3 and S4 can be operated in a linear mode in order to control the current flowing through the LED units. For example, the switches as described herein may be MOS, or any other suitable type, transistors.

When the DC output voltage is in an increasing state, the switches with one terminal coupled to the second output terminal can be turned on in sequence, in order to increase the number of the LED units in operation. Also, when the DC output voltage is in a decreasing state, the switches with one terminal coupled to the first output terminal can be turned on in sequence, in order to decrease the number of the LED units in operation. In accordance with the value of the DC output voltage, current can flow through corresponding LED units. As such, the LED units can be alternated in operation in order to improve the utilization of all LEDs to increase the lifetime of the LEDs.

Figure 2B:
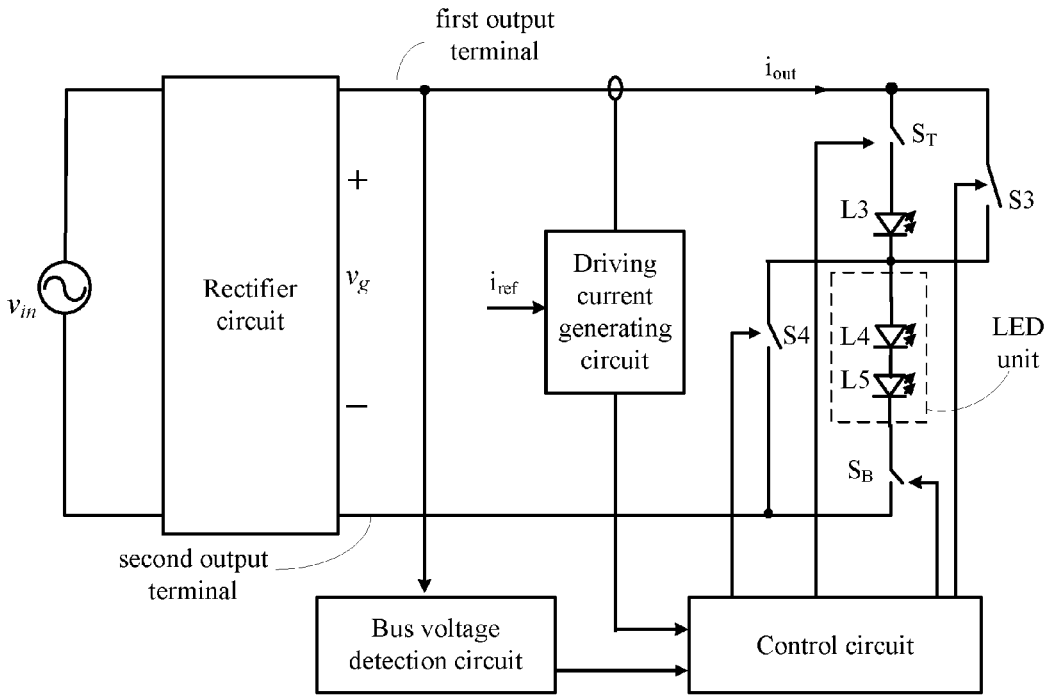
FIG. 2B is a schematic block diagram of a second example LED driver, in accordance with embodiments of the present invention.

Referring now to FIG. 2B, shown is a schematic block diagram of a second example LED driver, in accordance with embodiments of the present invention. In this particular example, the LED driver can include top side switch $S_T$ coupled between the first output terminal and the first LED unit (e.g., L3), and bottom side switch $S_B$ coupled between the second output terminal and the second LED unit (e.g., L4 and L5). For example, switches S3 and S4 can be controlled to be operated in on and off states, and top side switch $S_T$ and bottom side switch $S_B$ can be controlled to be operated in a linear mode, by the control circuit. When the DC output voltage is in an increasing state, top side switch $S_T$ may be on, and operated in a linear mode in order to control the current flowing through the LED units. Also, when the DC output voltage is in a decreasing state, bottom side switch $S_B$ may be on and operated in a linear mode in order to control the current flowing through the LED units.

Figure 3:
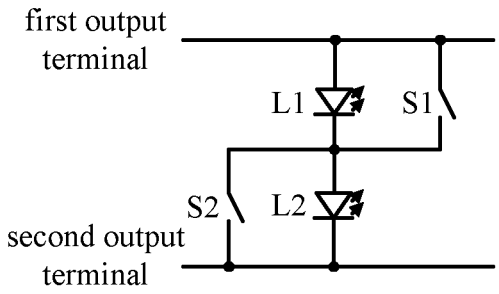
FIG. 3 is a schematic block diagram of a first example LED array, in accordance with embodiments of the present invention.

Referring now to FIG. 3, shown is a schematic block diagram of a first example LED array, in accordance with embodiments of the present invention. In this particular example, the LED array can include two LEDs L1 and L2, and two switches S1 and S2. A cathode of LED L1 can connect to an anode of LED L2. Moreover, an anode of LED L1 and a cathode of LED L2 can respectively connect to the first output terminal and the second output terminal of DC output voltage. Switches S1 and S2 can respectively connect in parallel with LED L1 and LED L2. The LED configuration control circuit may be utilized for controlling on and off states of the two switches S1 and S2.

For example, the first voltage value may be a minimum voltage level, and the third voltage value may be a maximum voltage level. Also, the first current value may be a maximum current value, and the third current value may be a minimum current value (e.g., one half of the first current value). Moreover, the LED configuration control circuit can turn off switch S1 or switch S2 when the bus voltage reaches the first voltage value, and can turn off both of switches S1 and S2 when the bus voltage reaches the third voltage value. In this particular example, switches S1 and S2 may be alternatively turned off each time when the bus voltage reaches the first voltage value, such that the utilization of the LEDs may be balanced.

When the bus voltage reaches the first voltage value, only one of LED L1 and LED L2 may be turned on, and $V_o$ may be equal to $V_L$, which can be a voltage drop across LED L1 or LED L2. The driving current generating circuit can adjust driving current $i_L$ to be $I_L$ that may be the first current value. Hence, output power $P_o$ may be $P_L$. When the bus voltage reaches the third voltage value, both of LED L1 and LED L2 can be turned on, and $V_o$ may be equal to $2V_L$. The driving current generating circuit can adjust driving current $i_L$ to be $I_L/2$, which may be the second current value. Hence, output power $P_o$ may remain $P_L$. The output voltage of this example circuit may be substantially constant, and the power dissipation may be minimized.

When the bus voltage reaches the first voltage value, only one of LED L1 and LED L2 may be turned on, and $V_o$ can be equal to $V_L$, which may be a voltage drop across LED L1 or LED L2. The driving current generating circuit can adjust the driving current $i_L$ to be $I_L/2$ which may be the second current value. Hence, output power $P_o$ may be $P_L/2$. When the bus voltage reaches the second voltage value, both of LED L1 and LED L2 can be turned on, and $V_o$ may be equal to $2V_L$. The driving current generating circuit can adjust driving current $i_L$ to be $I_L$, which may be the first current value. Hence, output power $P_o$ may be 2PL. This particular example circuit may have an increased voltage level, and thus a relatively high PF value.

Figure 4:
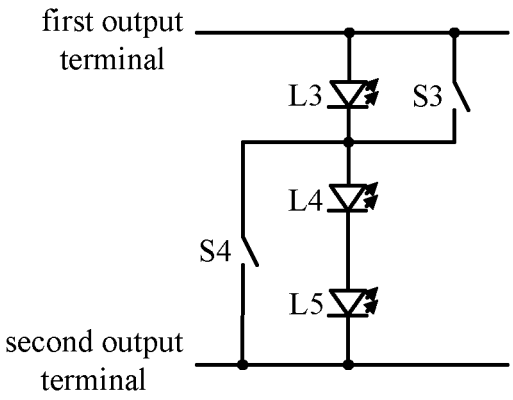
FIG. 4 is a schematic block diagram of a second example LED array, in accordance with embodiments of the present invention.
Figure 5:
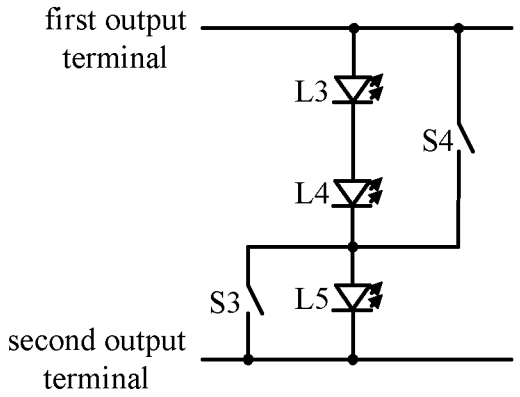
FIG. 5 is a schematic block diagram of a third example LED array, in accordance with embodiments of the present invention.

Referring now to FIGS. 4 and 5, shown are schematic block diagrams of second and third example LED arrays, in accordance with embodiments of the present invention. In these examples, the LED array can include three LEDs L3, L4, and L5, and two switches S3 and S4. A cathode of LED L3 can connect to an anode of LED L4, and a cathode of LED L4 can connect to an anode of LED L5. Moreover, an anode of LED L3 and a cathode of LED L5 can respectively connect to the first output terminal and the second output terminal of output voltage $V_o$. Switch S3 can connect in parallel with LED L3 or LED L5. Also, switch S4 can connect in parallel with other two of the LEDs L3 to L5. The LED configuration control circuit may be used for controlling on and off states of the two switches S3 and S4.

For example, the first voltage value may be a minimum voltage level, the third voltage value may be a maximum voltage level, and the second voltage value may be a value between the minimum and maximum voltage levels. Also, the first current value may be a maximum current value, the second current value may be a value between the minimum current value and a maximum current value (e.g., one half of the first current value), and the third current value may be the minimum value (e.g., one third of the first current value). Moreover, the LED configuration control circuit can turn off switch S3 when the bus voltage reaches the first voltage value, turn on switch S3 and turn off switch S4 when the bus voltage reaches the second voltage value, and turn off both of switches S3 and S4 when the bus voltage reaches the third voltage value.

When the bus voltage reaches the first voltage value, only one of LED L3 and LED L5 may be turned on, and $V_o$ may be equal to $V_L$, which can be a voltage drop across LED L3 or LED L5. The driving current generating circuit can adjust driving current $i_L$ to be $I_L$, which may be the first current value. Hence, output power $P_o$ may be $P_L$. When the bus voltage reaches the second voltage value, LED L4 and LED L5 can be turned on, or LED L3 and LED L4 can be turned on, and $V_o$ may be equal to $2V_L$. The driving current generating circuit can adjust the driving current $i_L$ to be $I_L/2$, which may be the second current value. Hence, output power $P_o$ may remain $P_L$. When the bus voltage reaches the third voltage value, all of LED L3, LED L4, and LED L5 can be turned on, and $V_o$ may be equal to $3V_L$. The driving current generating circuit can adjust driving current $i_L$ to be $I_L/3$, which may be the third current value. Hence, output power $P_o$ may remain $P_L$. The output voltage of this example circuit may be substantially constant, and the power dissipation may be minimized.

When the bus voltage reaches the first voltage value, only one of LED L3 and LED L5 may be turned on, and $V_o$ may be equal to $V_L$, which may be a voltage drop across LED L3 or LED L5. The driving current generating circuit can adjust driving current $i_L$ to be $I_L/3$ which may be the third current value. Hence, output power $P_o$ may be $P_L/3$. When the bus voltage reaches the second voltage value, LED L4 and LED L5 can be turned on, or LED L3 and LED L4 can be turned on, and $V_o$ may be equal to $2V_L$. The driving current generating circuit can adjust driving current $i_L$ to be $I_L/2$, which may be the second current value. Hence, output power $P_o$ may be $P_L$. When the bus voltage reaches the third voltage value, all of LED L3, LED L4, and LED L5 can be turned on, and $V_o$ may be equal to $3V_L$. The driving current generating circuit can adjust driving current $i_L$ to be $I_L$, which may be the first current value. Hence, output power $P_o$ may be 3PL. This example circuit may have an increased voltage level, and thus a relatively high PF value.

Figure 6:
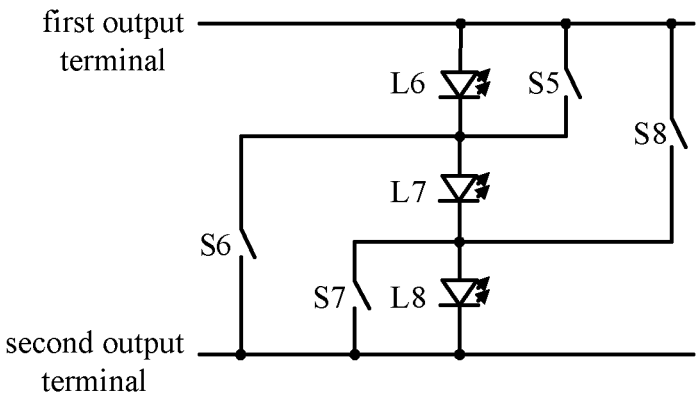
FIG. 6 is a schematic block diagram of a fourth example LED array in accordance with embodiments of the present invention.

Referring now to FIG. 6, shown is a schematic block diagram of a fourth example LED array in accordance with embodiments of the present invention. In this particular example, the LED array can include three LEDs L6, L7, and L8, and four switches S5, S6, S7, and S8. A cathode of LED L6 can connect to an anode of LED L7, and a cathode of LED L7 can connect to an anode of LED L8. Moreover, an anode of LED L6 and a cathode of LED L8 can respectively connect to the first output terminal and the second output terminal of output voltage $V_o$. Switch S5 can connect in parallel with LED L6, and switch S7 can connect in parallel with LED L8. Also, switch S6 can connect in parallel with LED L7 and LED L8, and switch S8 can connect in parallel with LED L6 and LED L7. The LED configuration control circuit can control on and off states of switches S5, S6, S7, and S8.

For example, the first voltage value is a minimum voltage level, the third voltage value may be a maximum voltage level, and the second voltage value may be a value between the minimum and maximum voltage levels. Also, the first current value may be a maximum current value, the second current value may be a value between the minimum current value and the maximum current value (e.g., one half of the first current value), and the third current value may be the minimum value (e.g., one third of the first current value).

Moreover, the LED configuration control circuit has two switching control modes. The two switching control modes can be changed from one to the other, instead of being performed simultaneously, so as to avoid flicker. In a first switching control mode, switches S7 and S8 can be maintained in an off state. The LED configuration control circuit can turn off switch S5 when the bus voltage reaches the first voltage value, turn on switch S5 and turn off switch S6 when the bus voltage reaches the second voltage value, and turn off both of switches S5 and S6 when the bus voltage reaches the third voltage value. In a second switching control mode, switches S5 and S6 can be maintained in an off state. The LED configuration control circuit can turn off switch S7 when the bus voltage reaches the first voltage value, turn on switch S7 and turn off switch S8 when the bus voltage reaches the second voltage value, and turn off both of switches S7 and S8 when the bus voltage reaches the third voltage value.

For example, the two switching control modes may be alternatively executed so as to balance the utilization of the LEDs. When the bus voltage reaches the first voltage value, only one of LED L6 and LED L8 may be turned on, and $V_o$ can be equal to $V_L$, which may be a voltage drop across LED L6 or LED L8. The driving current generating circuit can adjust the driving current $i_L$ to be $I_L$, which may be the first current value. Hence, output power $P_o$ may be $P_L$. When the bus voltage reaches the second voltage value, LED L7 and LED L8 can be turned on, or LED L6 and LED L7 can be turned on, and $V_o$ may be equal to $2V_L$. The driving current generating circuit can adjust driving current $i_L$ to be $I_L/2$, which may be the second current value. Hence, output power $P_o$ may remain $P_L$. When the bus voltage reaches the third voltage value, all of LED L6, LED L7, and LED L8 can be turned on, and $V_o$ may be equal to $3V_L$. The driving current generating circuit can adjust driving current $i_L$ to be $I_L/3$, which may be the third current value. Hence, output power $P_o$ may remain $P_L$. The output voltage of this example circuit may be substantially constant, and the power dissipation may be minimized.

When the bus voltage reaches the first voltage value, only one of LED L6 and LED L8 may be turned on, and $V_o$ may be equal to $V_L$, which can be a voltage drop across LED L6 or LED L8. The driving current generating circuit can adjust driving current $i_L$ to be $I_L/3$, which may be the third current value. Hence, output power $P_o$ may be $P_L/3$. When the bus voltage reaches the second voltage value, LED L7 and LED L8 can be turned on, or LED L6 and LED L7 can be turned on, and $V_o$ may be equal to $2V_L$. The driving current generating circuit can adjust driving current $i_L$ to be $I_L/2$, which may be the second current value. Hence, output power $P_o$ may be $P_L$. When the bus voltage reaches the third voltage value, all of LED L6, LED L7, and LED L8 can be turned on, and $V_o$ may be equal to $3V_L$. The driving current generating circuit can adjust driving current $i_L$ to be $I_L$, which may be the first current value. Hence, output power $P_o$ may be 3PL. This example circuit may have an increased voltage level, and thus a relatively high PF value.

Figure 7:
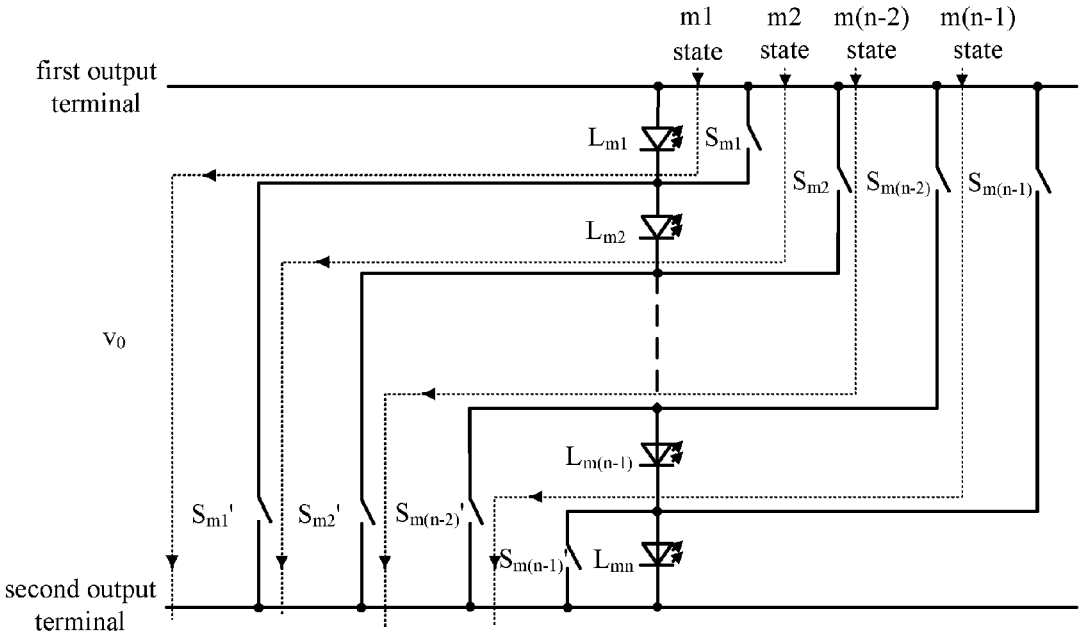
FIG. 7 is a schematic block diagram of a fifth example LED array, in accordance with embodiments of the present invention.

Referring now to FIG. 7, shown is a schematic block diagram of a fifth example LED array, in accordance with embodiments of the present invention. In this particular example, LEDs $L_{m1}$, $L_{m2}$, . . . , $L_{mn}$ can connect in series between a high output voltage terminal and a low output voltage terminal of an output voltage $V_o$. Switches $S_{m1}$, $S_{m2}$, . . . , $S_{m(n-1)}$ may each have one end connected to the high output voltage terminal of output voltage $V_o$, and the other end connected to a cathode of the respective one of the LEDs $L_{m1}$, $L_{m2}$, . . . , $L_{m(n-1)}$. Switches $S_{m1}'$, $S_{m2}'$, . . . , $S_{m(n-1)}'$ may each have one end connected to the low output voltage terminal of the output voltage $V_o$, and the other end connected to an anode of the respective one of the LEDs $L_{m2}$, . . . , $L_{mn}$. The LED configuration control circuit may have a plurality of switching control modes. The plurality of switching control modes, including the states m1, m2, . . . , and state m(n−1), can be changed from one to another, instead of being simultaneously executed.

The above configuration extension can control on and off states and utilization of the LEDs as required for the particular application. Each time when the bus voltage increases to a higher level, one more LED can be turned on and the driving current may be adjusted, such that the LED driver may have a relatively constant output power and/or a high power factor. The LED driver in certain embodiments may have an increased lifetime by balancing utilization of the LEDs, while reducing power dissipation and/or increasing PF value.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A light-emitting diode (LED) driver, comprising:

a) a rectifier circuit having an input for receiving an AC voltage, and an output for providing a DC output voltage by rectifying said AC voltage;

b) an LED array comprising N LED units having at least one LED coupled between a first output terminal and a second output terminal of said DC output voltage;

c) (N−1) groups of switches, each group of switches comprising two switches coupled in series between said first and second output terminals of said DC output voltage, wherein a common node of said two switches of each group is coupled to a common node between two adjacent LED units, and wherein the operation of said two switches of each group is complementary such that when said switch is on, said LED unit coupled in parallel with said switch is out of operation; and d) an LED configuration control circuit configured to control the on and off states of switches to correspondingly control operation of said LED units in accordance with a value of said DC output voltage and a current requirement for a current flowing through said LED units.

2. The LED driver of claim 1, wherein said current flowing through said LED units is controlled to follow the variation of said DC output voltage in order to achieve a high power factor.

3. The LED driver of claim 1, wherein said current flowing through said LED units is controlled to vary with the variation of said DC output voltage in order to achieve a constant power.

4. The LED driver of claim 1, wherein:

a) the number of said LED units in operation increases through control of said switches when said DC output voltage is in an increasing state; and b) the number of said LED units in operation decreases through control of said switches when said DC output voltage is in a decreasing state.

5. The LED driver of claim 4, wherein:

a) said switches with one terminal coupled to said second output terminal are turned on in sequence to increase the number of said LED units in operation when said DC output voltage is in an increasing state; and b) said switches with one terminal coupled to said first output terminal are turned on in sequence to decrease the number of said LED units in operation when said DC output voltage is in a decreasing state.

6. The LED driver of claim 4, wherein said switch is operated in a linear mode to control said current flowing through said LED units when said switches are turned on.

7. The LED driver of claim 1, further comprising:

a) a top side switch coupled between said first output terminal and a first LED unit; and b) a bottom side switch coupled between said second output terminal and an $N^{th}$ LED unit.

8. The LED driver of claim 7, wherein said switches are operated in on and off states, and said top and bottom side switches are operated in a linear mode.

9. The LED driver of claim 8, wherein:

a) said top side switch is on and operated in a linear mode to control the current flowing through said LED units when said DC output voltage is in an increasing state; and b) said bottom side switch is on and operated in a linear mode to control the current flowing through said LED units when said DC output voltage is in a decreasing state.

10. The LED driver of claim 1, further comprising a bus voltage detection circuit configured to detect said DC output voltage.

11. The LED driver of claim 10, further comprising a driving current generating circuit configured to control said current flowing through said LED units.

12. The LED driver of claim 11, wherein said driving current generating circuit is configured to divide said DC output voltage into a plurality of levels, and to divide said current flowing through said LED units into a plurality of corresponding levels.

13. The LED driver of claim 12, wherein said driving current generating circuit is configured to generate said current that is adjusted in accordance with an actual operation state of each LED in said LED array, and wherein when said output power of said LED driver is constant:

a) said number of said LEDs connected in series in an on state has a minimum value, and said driving current is adjusted to be a first current value, when said bus voltage detection circuit detects that said bus voltage has a first voltage value;

b) said number of said LEDs connected in series in an on state has a value between said minimum value and a maximum value, and said driving current is adjusted to be a second current value, when said bus voltage detection circuit detects that said bus voltage has a second voltage value; and c) said number of said LEDs connected in series in an on state has said maximum value, and said driving current is adjusted to be a third current value, when said bus voltage detection circuit detects that said bus voltage has a third voltage value.

14. The LED driver of claim 12, wherein said driving current generating circuit is configured to generate said current that is adjusted in accordance with an actual operation state of each LED in said LED array, and when said LED driver has a high power factor:

a) said number of said LEDs connected in series in an on state has a minimum value, and said driving current is adjusted to be a third current value, when said bus voltage detection circuit detects that said bus voltage has a first voltage value;

b) said number of said LEDs connected in series in an on state has a value between said minimum value and a maximum value, and said driving current is adjusted to be a second current value, when said bus voltage detection circuit detects that said bus voltage has a second voltage value; and c) said number of said LEDs connected in series in an on state has said maximum value, and said driving current is adjusted to be a first current value, when said bus voltage detection circuit detects that said bus voltage has a third voltage value.

* * * * *